US007409844B2

(12) United States Patent
Ingvarsson

(10) Patent No.: US 7,409,844 B2
(45) Date of Patent: Aug. 12, 2008

(54) APPARATUS FOR THINNING UPSTANDING SIDES OF METAL SHEETS

(75) Inventor: Lars Ingvarsson, Borlange (SE)

(73) Assignee: Ortic AB, Borlange (SE)

( * ) Notice: Subject to any disclaimer, the term of this patent is extended or adjusted under 35 U.S.C. 154(b) by 759 days.

(21) Appl. No.: 10/806,865

(22) Filed: Mar. 23, 2004

(65) Prior Publication Data

US 2004/0173002 A1 Sep. 9, 2004

Related U.S. Application Data

(63) Continuation-in-part of application No. PCT/SE02/01689, filed on Sep. 18, 2002.

(30) Foreign Application Priority Data

Sep. 27, 2001 (SE) ..... 0103229

(51) Int. Cl.
*B21D 5/08* (2006.01)

(52) U.S. Cl. ..... 72/167

(58) Field of Classification Search ..... 72/167, 72/178, 181, 182

See application file for complete search history.

(56) References Cited

U.S. PATENT DOCUMENTS

| | | | | | |
|---|---|---|---|---|---|
| 670,498 | A | * | 3/1901 | Hoskins | 72/224 |
| 1,397,271 | A | * | 11/1921 | Eckenroth | 72/124 |
| 1,649,613 | A | * | 11/1927 | Olson | 72/178 |
| 2,098,989 | A | * | 11/1937 | Yoder | 228/151 |
| 3,355,922 | A | * | 12/1967 | Utashiro et al. | 72/178 |
| 3,472,053 | A | * | 10/1969 | Chang | 72/178 |
| 4,558,577 | A | * | 12/1985 | Trishevsky et al. | 72/12.7 |
| 5,090,227 | A | * | 2/1992 | Takeda et al. | 72/178 |
| 5,253,501 | A | * | 10/1993 | Spath | 72/167 |
| 6,109,083 | A | * | 8/2000 | Steinmair | 72/181 |

FOREIGN PATENT DOCUMENTS

JP 59-27723 * 2/1984

OTHER PUBLICATIONS

Japanese Publication No. 11-047836, Published Feb. 23, 1999—Toyota Motor Company.

* cited by examiner

*Primary Examiner*—Daniel C Crane
(74) *Attorney, Agent, or Firm*—Mark P. Stone

(57) ABSTRACT

Metal sheets, and in particular, metal sheets for roofing of the kind having upstanding flat edges ending with beads, are bent by rolling the flat edges such that they become gradually thinner towards the beads. The sheets will also be bent if the beads are not rolled.

15 Claims, 3 Drawing Sheets

APPARATUS FOR THINNING UPSTANDING SIDES OF METAL SHEETS

This application is a continuation-in-part of International Application PCT/SE02/01689, having an international filing date of Sep. 18, 2002, published in English under PCT Article 21(2).

TECHNICAL AREA

This invention relates to a bending apparatus for metal sheets with upstanding sides and to a method of bending metal sheets that have upstanding flat sides ending with beads.

BACKGROUND TECHNIQUE

A method of cladding a roof with metal sheets is the standing seam method in which the steel sheets have upstanding longitudinal edges that end with snap-on beads. The beads may then be rolled tight. The seams are so high that there could never be so much water on the roof that the water could reach the upper ends of the seams. The seams could for example be 8 cm high and, usually, full length sheets are used so that there are no transverse joints. This method is not used for cupola roofs whether or not they have constant or varied bending radius since the roofing sheets must then be bent before they are mounted. The sheets may be of metals such as steel, aluminum, zinc, or copper.

OBJECT OF INVENTION

It is an object of the invention to provide a bending apparatus for metal sheets, including but not limited to metal sheets for roofing, with upstanding edges, and in particular such an apparatus that permits for a variable bending radius, and to provide a method for bending a metal sheet that has upstanding flat edges ending with beads, and in particular a method of bending a sheet with a radius that varies along the length of the sheet. This is accomplished principally in that, without rolling the beads, one rolls the flat edges gradually thinner towards the beads, and in particular in that one varies the thinning.

DESCRIPTION OF AN ILLUSTRATED AND PREFERRED EMBODIMENT

Figure 1:
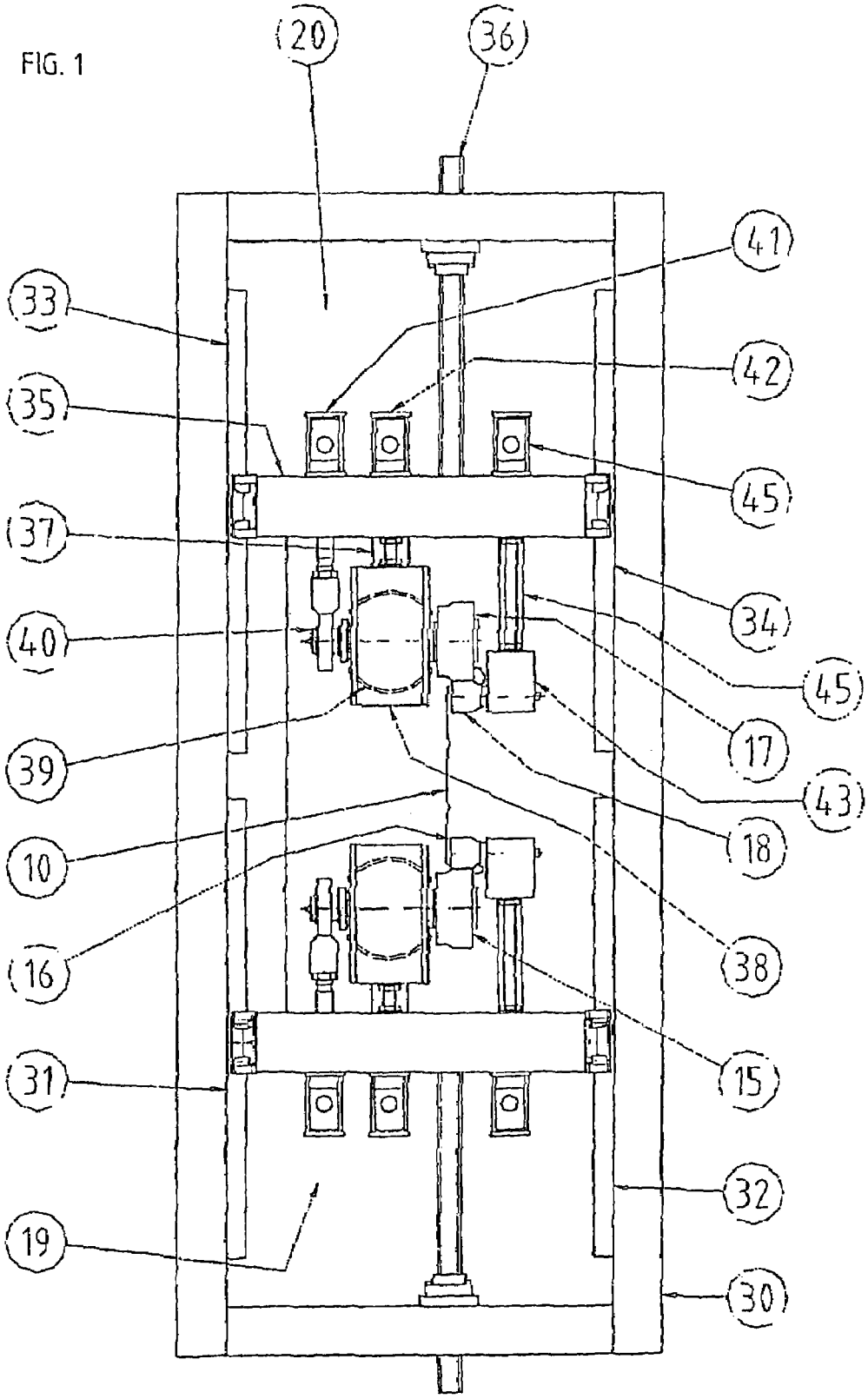
FIG. 1 shows, in a cross sectional view, the rolling unit of a bending apparatus.
Figure 2:
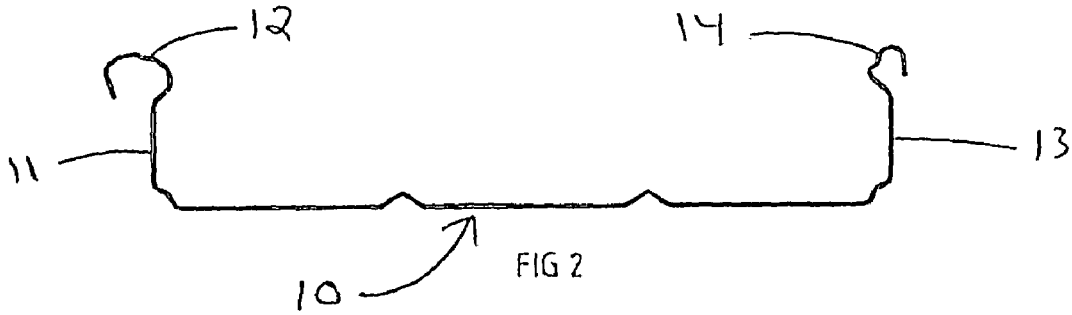
FIG. 2 shows, on a larger scale and in cross section, a metal sheet that is also shown in FIG. 1 and it is an end view seen as indicated by the arrows 2-2 in FIG. 4.
Figure 3:
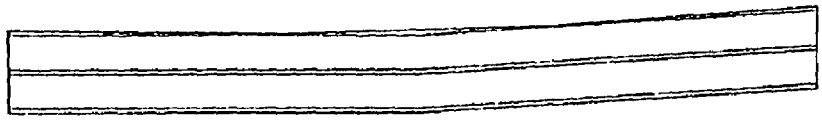
FIGS. 3-5 are examples of metal sheets that can be bent by the device shown in FIG. 1.
Figure 4:
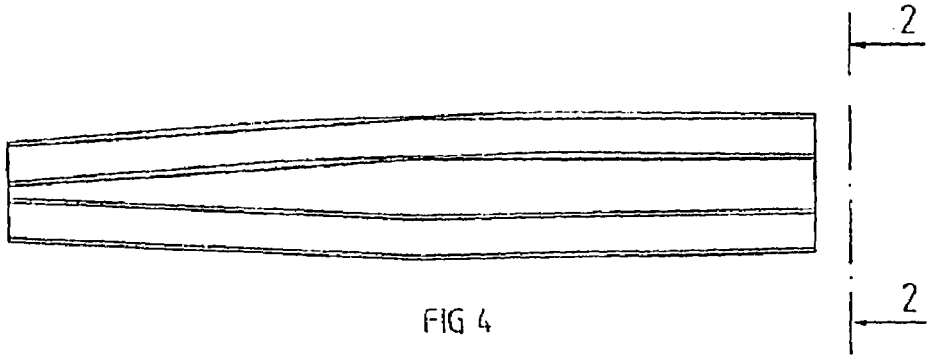
Figure 5:
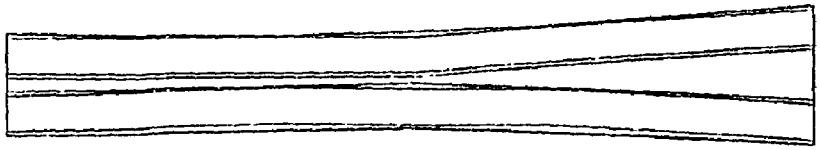

In FIG. 1, the rolling unit in a bending apparatus is shown during the rolling of a metal sheet, such as a roofing sheet 10 with upstanding edges, 11, 13 that end in beads 12, 14 as can best be seen in FIG. 2. One of the beads 12 is larger than the other bead 14 so that the beads of two adjacent sheets can be snapped together and if necessary also then be rolled sealed.

The flat parts of the edges 11, 13 are clamped between two rolls 15, 16 and 17, 18, respectively, of two rolling devices 19, 20.

The rolling unit comprises a frame 30 with guides in the form of guide rails 31, 32 and 33, 34, respectively, for the two rolling devices 19, 20. Since the two rolling devices, each one for rolling an upstanding edge 11, 13, are similar, only the rolling device 20 is described in detail. It has a frame 35 that is slidably carried and guided by the guide rails 33, 34. The frame 35 can be moved along the guide rails by means of a ball screw 36. The frame 35 carries slidably on a guide 37 a bearing housing 38 in which an inner bearing part 39 is turnable. An axle 40 for the roll 17 is journaled in this bearing part 39. The bearing part 39 is turnable in the bearing housing 38 by means of a ball screw 41, and the bearing housing 38 is movable along the guide 37 by means of ball screw 42. The roll 18, the counter roll, is journalled in a housing 43, the position of which is adjustable by means of a ball screw 45.

Besides the illustrated rolling unit, the bending apparatus comprises an input unit with powered feeding-in rollers and an output unit also having powered rollers. These two units are conventional and are therefore not illustrated.

By angular adjustment of the rolls 15, 16 by means of the ball screw 41, one may roll the edges 11 and 13 gradually thinner towards beads 12 and 14, which makes the outer parts of the edges longer and bends the sheet. Surprisingly, the sheet will bend although the beads are not rolled thinner. By adjusting the obliqueness of the rolls 15, 17, one can vary the radius of bending. Since such adjustment will also displace the rolls 15, 17, one must also adjust the position of the housing 38 by means of the ball screw 42 and also adjust the position of the corresponding housing of the rolling device 19. When one wants a sheet with a varying radius of bending along its length, one can carry out these adjustments during the rolling. The ball screws can be controlled by motors controlled by a computer. The programming can be carried out based on experience, and fine adjustment can be carried out in a test rolling. In this way, one may make long roofing sheets for roofs with a varying slope. By means of the ball screw, one can adjust the device to various sheet thicknesses.

By adjusting the inclination of the rollers 15, 17 so that they roll the edges 11 and 13 thinner towards the edge base, one can also make the sheet bend somewhat upwards, but in order to get a bigger bending upwards, one may also roll the flat middle portion of the sheet. Such a rolling unit can be added to the machine for that purpose.

Figure 6:
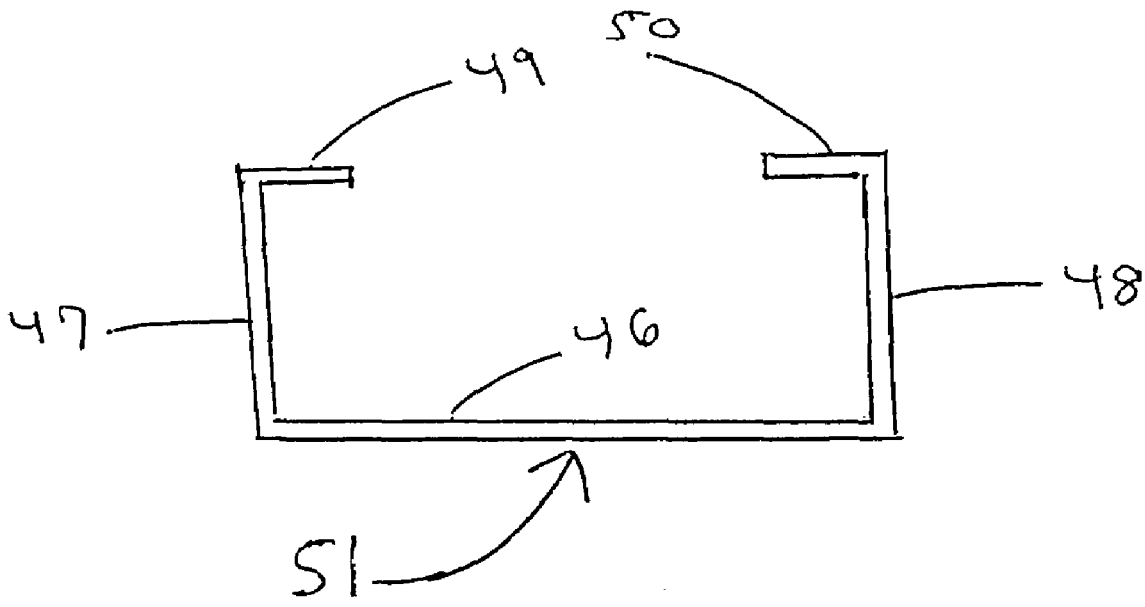
FIG. 6 is a cross section of another bent metal sheet, illustrating a further example of the configuration of bent metal sheets in accordance with the present invention.

FIG. 6 illustrates, in cross section, an example of a configuration of a metal sheet bent in accordance with the present invention. The metal sheet generally illustrated by reference numeral 51 includes a base or flat middle component 46, two upwardly bent side components 47, 48, and two inwardly bent end components 49, 50, and can be bent in the same way as the sheet shown in FIG. 2. The profile of the bent metal sheet 45 can be twisted by thinning one side upwardly and by thinning the other side downwardly. Additionally, both the width and height of the profile of the sheet can be varied by varying the positions along which the components are bent. Thus, the rolling of the metal sheet can be controlled to simultaneously produce both bending and twisting of the metal sheet.

The rolling devices 19, 20 can be moved along the guides 31-34 during the rolling so that one may roll roofing sheets of the kind shown in FIGS. 3-6 having varying width. Such sheets are adapted for example for cupola roofs. Sheets having bow-formed sides with a constant radius are adapted for cupola roofs having constant radius of their bows, whereas sheets having bow-formed sides with a varying radius are adapted for cupola roofs having varying radius of their bows.

It is possible to bend sheets with a bending radius that varies along their length. Sometimes it will also be necessary to bend sheets of the kind shown in FIG. 3 which have their one side convex and their other side concave.

During the bending of a sheet, one controls the ball screws 36 so that the bending apparatus is continuously adapted to the change of the width of the sheet. The ball screws 41 and 42 are simultaneously controlled so that the bending is adapted to the change of width in accordance with algorithms defined for the form of sheet, that is, in accordance with a predefined schedule.

Instead of compulsory controlling the rolling devices 19, 20 along the guides 31-34, one can have the rolling devices freely movable along the guides so that they are guided by the upstanding edges of the sheet. A balanced pneumatic device may be provided to initially set the positions of the rolling devices on the guides and then have the sheet edges guiding their positions on the guides.

Although the preferred embodiments of the invention have been discussed herein primarily with respect to metal sheets for roofing, the methods and apparatus of the present invention may also be employed for bending of metal sheets for applications other than roofing. Accordingly, the preferred embodiments of the invention discussed herein are intended to be illustrative only, and not restrictive of the scope of the invention, that scope being defined by the following claims and all equivalents thereto.

The invention claimed is:

1. A bending apparatus for bending a profile of a metal sheet with upstanding sides (11, 13), said apparatus comprising, for each said upstanding side: a rolling device (19, 20) with a pair of rollers (15, 16; 17, 18) for rolling said upstanding side between said pair of rollers for selectively thinning a part of said upstanding side of said metal sheet for bending said profile of said metal sheet; a device (42) for adjusting the rolling force of said pair of rollers; and a device (40, 41) for adjusting the angle between the axes of said pair of rollers for selectively thinning a part of said upstanding side of said metal sheet for bending said profile of said metal sheet; wherein said rolling devices (19, 20) are movably carried by a frame (30) so as to be movable towards and away from each other along guides (31-34) for adaptation to the width of the profile; and wherein the devices for adjusting the angle between the axes of the rollers and for adjusting the rolling force of the rollers comprise ball screws (41, 42) controlled by motors.

2. The bending apparatus according to claim 1, wherein the rolling devices (19, 20) are freely movable sideways and are guided sideways by the upstanding sides of the sheet for adaptation to the width of the sheet.

3. The bending device according to claim 2, further including ball screws (36) for displacing the rolling devices (19, 20) along said guides (31-34).

4. The bending device according to claim 1, further including ball screws (36) for displacing the rolling devices (19, 20) along guides (31-34).

5. A bending apparatus for bending a metal sheet with upstanding sides (11, 13), said apparatus comprising, for each said upstanding side: a rolling device (19, 20) with a pair of rollers (15, 16; 17, 18) for rolling said upstanding side between said pair of rollers; a device (42) for adjusting the rolling force of said pair of rollers; and a device (40, 41) for adjusting the angle between the axes of said pair of rollers;

wherein said rolling devices (19, 20) are movably carried by a frame (30) so as to be movable towards and away from each other along guides (31-34) for adjusting the width of the sheet, wherein the rolling devices (19, 20) are freely movable sideways and are guided sideways by the upstanding sides of the sheet for adaptation to the width of the sheet, wherein the devices for adjusting the angle between the axes of the rollers and for adjusting the rolling force of the rollers comprise ball screws (41, 42) controlled by motors.

6. The bending apparatus according to claim 5, further including ball screws (36) for displacing the rolling devices (19, 20) along guides (31-34).

7. A bending apparatus for bending a profile of a metal sheet with upstanding sides (11, 13), said apparatus comprising, for each said upstanding side: a rolling device (19, 20) with a pair of rollers (15, 16; 17, 18) for rolling said upstanding side between said pair of rollers for selectively thinning a part of said upstanding side of said metal sheet for bending said profile of said metal sheet; a device (42) for adjusting the rolling force of said pair of rollers; and a device (40, 41) for adjusting the angle between the axes of said pair of rollers for selectively thinning a part of said upstanding side of said metal sheet for bending said profile of said metal sheet; wherein said rolling devices (19, 20) are movably carried by a frame (30) so as to be movable towards and away from each other along guides (31-34) for adaptation to the width of the profile; said bending apparatus further including means for controlling said device (42) for adjusting the rolling force of said pair of rollers during a bending operation.

8. The bending apparatus according to claim 7, wherein the rolling devices (19, 20) are freely movable sideways and are guided sideways by the upstanding sides of the sheet for adaptation to the width of the sheet.

9. The bending apparatus according to claim 7, further including ball screws (36) for displacing the rolling devices (19, 20) along guides (31-34).

10. A bending apparatus for bending a profile of a metal sheet with upstanding sides (11, 13), said apparatus comprising, for each said upstanding side: a rolling device (19, 20) with a pair of rollers (15, 16; 17, 18) for rolling said upstanding side between said pair of rollers for selectively thinning a part of said upstanding side of said metal sheet for bending said profile of said metal sheet; a device (42) for adjusting the rolling force of said pair of rollers; and a device (40, 41) for adjusting the angle between the axes of said pair of rollers for selectively thinning a part of said upstanding side of said metal sheet for bending said profile of said metal sheet; wherein said rolling devices (19, 20) are movably carried by a frame (30) 50 as to be movable towards and away from each other along guides (31-34) for adaptation to the width of the profile; said bending apparatus further including means for controlling said device (40, 41) for adjusting the angle between the axes of said pair of rollers during a bending operation.

11. The bending apparatus according to claim 10, wherein the rolling devices (19, 20) are freely movable sideways and are guided sideways by the upstanding sides of the sheet for adaptation to the width of the sheet.

12. The bending apparatus according to claim 10, further including ball screws (36) for displacing the rolling devices (19, 20) along guides (31-34).

13. A bending apparatus for bending a profile of a metal sheet with upstanding sides (11, 13), said apparatus comprising, for each said upstanding side: a rolling device (19, 20) with a pair of rollers (15, 16; 17, 18) for rolling said upstanding side between said pair of rollers for selectively thinning a part of said upstanding side of said metal sheet for bending said profile of said metal sheet; a device (42) for adjusting the rolling force of said pair of rollers; and a device (40, 41) for adjusting the angle between the axes of said pair of rollers for selectively thinning a part of said upstanding side of said metal sheet for bending said profile of said metal sheet; wherein said rolling devices (19, 20) are movably carried by a frame (30) 50 as to be movable towards and away from each other along guides (31-34) for adaptation to the width of the profile; said bending apparatus further including first means for controlling said device (42) for adjusting the rolling force of said pair of rollers during a bending operation, and second means for controlling said device (40, 41) for adjusting the angle between the axes of said pair of rollers during a bending operation. freely movable sideways and are guided sideways by the upstanding sides of the sheet for adaptation to the width of the sheet.

14. The bending apparatus according to claim 13, wherein the rolling devices (19, 20) are freely movable sideways and are guided sideways by the upstanding sides of the sheet for adaptation to the width of the sheet.

15. The bending apparatus according to claim 13, further including ball screws (36) for displacing the rolling devices (19, 20) along guides (31-34).

* * * * *

UNITED STATES PATENT AND TRADEMARK OFFICE

CERTIFICATE OF CORRECTION

PATENT NO. : 7,409,844 B2
APPLICATION NO. : 10/806865
DATED : August 12, 2008
INVENTOR(S) : Lars Ingvarsson It is certified that error appears in the above-identified patent and that said Letters Patent is hereby corrected as shown below:

Column 4, Line 47 (Claim 10, Line 13):
Delete "50" and substitute -- so --.

Column 5, Line 5 (Claim 13, Line 13):
Delete "50" and substitute -- so --.

Column 6, Lines 1 - 3 (Claim 13, Lines 20 - 22):
Delete "freely movable sideways and are guided sideways by the upstanding sides of the sheet for adaptation to the width of the sheet".

Signed and Sealed this

Seventh Day of October, 2008

JON W. DUDAS
*Director of the United States Patent and Trademark Office*